US007682539B1

(12) United States Patent
Phillips et al.

(10) Patent No.: US 7,682,539 B1
(45) **Date of Patent: *Mar. 23, 2010**

(54) REGENERATION OF SILK AND SILK-LIKE FIBERS FROM IONIC LIQUID SPIN DOPES

(75) Inventors: David M. Phillips, Dayton, OH (US); Robert A. Mantz, Efland, NC (US); Paul C. Trulove, Annapolis, MD (US); Hugh C. DeLong, Waldorf, MD (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 398 days.

This patent is subject to a terminal disclaimer.

(21) Appl. No.: 11/655,041

(22) Filed: Jan. 10, 2007

Related U.S. Application Data

(60) Provisional application No. 60/762,212, filed on Jan. 11, 2006.

(51) Int. Cl.
*D01F 4/00* (2006.01)

(52) U.S. Cl. ..... 264/202

(58) Field of Classification Search ..... 264/202
See application file for complete search history.

(56) References Cited

U.S. PATENT DOCUMENTS

| | | | | |
|---|---|---|---|---|
| 5,216,114 | A * | 6/1993 | Walles et al. | 528/173 |
| 5,252,285 | A | 10/1993 | Lock | |
| 5,378,469 | A * | 1/1995 | Kemp et al. | 424/423 |
| 2003/0150723 | A1 * | 8/2003 | Kayyem et al. | 204/403.01 |
| 2003/0155670 | A1 * | 8/2003 | O'Brien | 264/28 |

OTHER PUBLICATIONS

D.M. Phillips et al., "Regenerated Silk Fiber Wet Spinning from an Ionic Liquid Solution", Journal of Materials Chemistry, 2005, pp. 4206-4208, vol. 15.

D.M. Phillips et al., "Dissolution and Regeneration of *Bombyx mori* Silk Fibroin Using Ionic Liquids", Journal of the American Chemical Society, 2004, pp. 14350-14351, vol. 126.

G.H. Altman et al., "Silk-Based Biomaterials", Biomaterials, 2003, pp. 401-416, vol. 24, Elsevier.

K.A. Trabbic et al., "Comparative Structural Chracterization of Naturally- and Synthetically-Spun Fibers of *Bombyx mori* Fibroin", Marcomolecules, 1998, pp. 462-471, vol. 31.

J. Yao et al., "Artificial Spinning and Characterization of Silk Fiber from *Bombyx mori* Silk Fibroin in Hexafluoroacetone Hydrate", Macromolecules, 2002, pp. 6-9, vol. 35.

C. Zhao et al., "Structural Characterization and Artificial Fiber Formation of *Bombyx mori* Silk Fibroin in Hexafluoro-Iso-Propanol Solvent System", Biopolymers, 2003, pp. 253-259, vol. 69, Wiley Periodicals, Inc.

0. Liivak et al., "A Microfabricated Wet-Spinning Apparatus to Spin Fibers of Silk Proteins. Structure-Property Correlations", Macromolecules, 1998, pp. 2947-2951, vol. 31.

* cited by examiner

*Primary Examiner*—Joseph S Del Sole
*Assistant Examiner*—David N Brown, II
(74) *Attorney, Agent, or Firm*—AFMCLO/JAZ; Bart S. Hersko

(57) ABSTRACT

The present invention relates to a process of forming fibers of silk and silk-like proteins in a solution with a solvent consisting of a pure ionic liquid, an ionic liquid mixture, an ionic liquid mixed with one or more cosolvents, or an ionic liquid mixture mixed with one or more cosolvents. A solution is extruded through a spinneret orifice to form a fiber. The spinneret is either directly immersed in the coagulation bath or the spinneret is surrounded by a noncoagulating medium (i.e., air or other inert fluid) and the extruded fiber is subsequently immersed in a coagulation bath. Fibers may also be formed by extruding a fiber directly from a reservoir of solution into a noncoagulating, inert medium and then immersing the extruded fibers into a coagulation bath to rinse the fiber of ionic liquid.

19 Claims, No Drawings

REGENERATION OF SILK AND SILK-LIKE FIBERS FROM IONIC LIQUID SPIN DOPES

CROSS REFERENCE TO RELATED APPLICATION

This application claims priority of the filing date of Provisional Application Ser. No. 60/762,212, filed on Jan. 11, 2006.

RIGHTS OF THE GOVERNMENT

The invention described herein may be manufactured and used by or for the Government of the United States for all governmental purposes without the payment of any royalty.

BACKGROUND OF THE INVENTION

The invention relates to the process of spinning fibers of silk and silk-like proteins from an admixture of solubilized silk or silk-like protein in an ionic liquid solvent.

Artificial spinning methods for silk fibroin have typically fallen into the categories of wet spinning and electrospinning. Wet spinning has the advantage of producing reelable fiber that can be drawn and tested for mechanical properties. Electrospinning can produce extremely fine fibers in the form of a non-woven mat, however mechanical testing of individual fibers is not feasible. These electrospun mats can be used as scaffolds for biomedical applications.

In previously reported results, spin dopes have been formed with silk fibroin dissolved in 1,1,1,3,3,3-hexafluoro-2-propanol (HFIP) (U.S. Pat. No. 5,252,285), hexafluoroacetone (HFA), formic acid, trifluoroacetic acid (TFA), and water mixed with polyethylene oxide (PEO). All of these spin dopes require a time-consuming, multistep process, where the silk fibroin is first washed of the glue-like sericin covering the fiber, dissolved in a salt based solvent, dialysed, and dried to eliminate the β-sheet crystal structure before the fibroin is soluble in the spinning solvent. It has been shown previously that silk fibroin is directly soluble in organic-based ionic liquids, both with or without the sericin present, as in U.S. patent application Ser. No. 11/326,678, incorporated herein by reference. These ionic liquid silk solutions were used to cast films of silk. As a spin dope, ionic liquids exhibit several advantages over the aforementioned spin dopes, such as negligible volatility and ease of solvent recovery.

The approach to wet spinning of silk fibroin from the silkworm *Bombyx mori* has varied in terms of equipment, i.e. a syringe pump with a hypodermic needle, a cylinder pressurized with $N_2$ gas to force the spin dopes through a spinneret, and a syringe pump with a tapered spinneret etched in silicon to better control the fiber crystallite orientation. These spinning techniques typically utilize a methanol coagulation bath to remove the spinning solvent and induce crystallization in the fibers. Subsequent post-spin fiber drawing is typically conducted after soaking the fibers overnight in a methanol bath while the fibers were wet with methanol or water. Some fibers have been steam annealed. The drawing and annealing improve both the maximum modulus and the strain to break of the fibers.

SUMMARY OF THE INVENTION

The present invention relates to a process of forming fibers of silk and silk-like proteins in a solution with a solvent consisting of a pure ionic liquid, an ionic liquid mixture, an ionic liquid mixed with one or more cosolvents, or an ionic liquid mixture mixed with one or more cosolvents. A solution is extruded through a spinneret orifice to form a fiber. The spinneret is either directly immersed in the coagulation bath or the spinneret is surrounded by a noncoagulating medium (i.e., air or other inert fluid) and the extruded fiber is subsequently immersed in a coagulation bath. Fibers may also be formed by extruding a fiber directly from a reservoir of solution into a noncoagulating, inert medium and then immersing the extruded fibers into a coagulation bath to rinse the fiber of ionic liquid.

DETAILED DESCRIPTION

Silk and silk-like proteins are readily soluble in ionic liquid solvents. See, e.g., U.S. patent application Ser. No. 11/326,678, filed on Dec. 29, 2005, incorporated herein by reference. These silk in ionic liquid solutions can be used as spin dopes to form fibers. The present invention allows for custom diameters of silk and silk-like fibers to be formed via wet spinning, dry-jet wet spinning, drawing or extrusion. For natural silk proteins, the present invention allows for diameters and properties that are not found in nature.

As used herein the term "ionic liquid" refers to a liquid that is comprised of anions and cations. Ionic liquids are attractive solvents as they are non-volatile, non-flammable, have a high thermal stability, are relatively inexpensive to manufacture, are environmentally friendly, and can be used to provide greater control and flexibility in the overall processing methodology. Ionic liquids of interest exist as liquids well below room temperature up to a temperature as high as 200° C. U.S. patent application Ser. No. 11/326,678, filed on Dec. 29, 2005, referred to above, contains numerous examples of suitable ionic liquid solvents for dissolving silk and silk-like proteins.

Viscosity can become an issue with ionic liquid solutions as the silk content is increased. To be useful as a spin dope, the solution must flow and must have a high enough silk or silk-like protein concentration to allow the molecules to hydrogen bond during the spinning process. A typical spin dope contains about 20% (w/w) of silk or silk-like protein loading. To reduce the viscosity, the temperature can be increased to near the neat ionic liquid melting temperature or a compatible cosolvent can be added. Both means are feasible, however prolonged exposure to elevated temperature can degrade the silk or silk-like protein.

A desirable cosolvent that is miscible with the ionic liquid can be used to lower the solution viscosity without causing the silk or silk-like protein to crash from the solution. It is desirable to have the cosolvent poise the solution for crashing so that the spinning process induces aligned crystallization within the fiber without the aid of a coagulation bath or post-spin drawing. Compatible cosolvents include but are not limited to water, methanol, ethanol, 1-propanol, 2-propanol, 1-butanol, 2-butanol, 2-methyl-1-propanol, 2-methyl-2-propanol, or acetonitrile or mixtures thereof.

The spinnable solution may then be spun into fibers using elements known in the art. These processes include, for example, wet spinning, dry-jet wet spinning, and extrusion/drawing. The choice of the ionic liquid and cosolvent makes the spin dope solutions highly tunable to be compatible with the various spinning methods.

In the wet spinning process, the spinning solution is extruded through a spinneret directly into a coagulating bath. The coagulant may be any fluid wherein the ionic liquid and cosolvent(s) are soluble, but wherein the silk or silk-like protein is not. Examples of suitable fluids include but are not limited to water, methanol, ethanol, 1-propanol, 2-propanol, 1-butanol, 2-butanol, 2-methyl-1-propanol, 2-methyl-2-propanol, or acetonitrile or mixtures thereof. Methanol is a preferred coagulant because in addition to removing the ionic liquid from the fiber, it induces crystalline β-sheet formation within the fibers. The fibers can be cold drawn while still wet with the coagulant to modify their mechanical properties. Preferably, the fibers are dried while under tension to improve their tensile properties.

In dry-jet wet spinning, the spinning solution is extruded through a spinneret; attenuated and stretched in an inert, noncoagulating medium; and then immersed into a coagulating medium in a fashion similar to wet jet spinning. Care must be taken with the choice of medium when using ionic liquids. For example, humidity in the air can be absorbed into the spun fiber and possibly cause the silk or silk-like protein to redissolve. This can lead to fiber breakage.

In extrusion/drawing, the fiber is pulled directly from a reservoir of spin dope; attenuated and stretched in an inert, noncoagulating medium; and then immersed into a coagulating medium in a fashion similar to dry-jet wet spinning. As in dry-jet wet spinning, care must be taken with the choice of medium when using ionic liquids.

The following examples further describe the invention but should not be construed as limiting the scope of the invention.

Example 1

Spinning of Silk Fibroin from *Bombyx mori* with the Dry-Jet Wet Spinning

For this work, the spin dope was prepared from silkworm cocoon silk dissolved in the ionic liquid 1-ethyl-3-methylimidazolium chloride (EMIC). The silk for this work was grown in house with silkworms raised on a diet consisting exclusively of Silkworm Chow (Mulberry Farms, Fallbrook, Calif.). The cocoons were harvested between two and seven days of spinning by cutting the cocoons to release the pupae unharmed, which reduces the contaminants in the silk. To remove the sericin, the cocoons were boiled in a 50 mM $Na_2CO_3$ and 50 mM $Na_2EDTA$ solution, thoroughly rinsed in distilled, deionized water, and lyophilized. The dried silk was mixed with the dry EMIC to make a 10% (w/w) spin dope solution. To dissolve the silk, the spin dope was heated at 95° C. and stirred while exposed to ambient air with a 20% RH. The water content of the final spin dope cooled to room temperature was 1.62±2.00% (w/w) as determined via headspace analysis using a Mettler Toledo DL39 Karl Fischer coulometer connected to a Stromboli® oven sample changer. Spin dope was also prepared under a dry $N_2$ atmosphere, however, the dry spin dope was glassy at room temperature and unusable in our spinning apparatus.

For the spinning equipment, applicants used a glass syringe fitted with a 26 gauge, blunt tip needle with an inside diameter of 0.26 mm and an overall length of 23 mm. The spin dope was placed into the syringe while hot, and the air was removed. The spinning was performed by extruding the spin dope at a rate of approximately 3 m/min across a 50 mm air gap into a coagulation bath. The extruded fiber swelled to a diameter of about 1 mm before entering the coagulation bath.

TABLE 1

Coagulation Bath Solvent Effect

| Solvent | Effect on Spin Dope |
|---|---|
| Methanol | Solidified, clear fibers |
| Acetonitrile | Solidified, white crusted, brittle fibers |
| Water | Dissolved with residual, gossamer fibers [a] |
| Ethyl acetate | Droplet formation [b] |
| Acetone | Droplet formation [b] |
| Hexanes | Droplet formation [b] |

[a] Only a small amount of silk remained in a fiber skeleton.
[b] The ionic liquid was immiscible with the coagulation solvent.

Several solvents were tested as coagulation baths. The coagulation bath solvent effects for the spun fibers are listed in Table 1. The methanol bath formed clear, solid fibers, the acetonitrile bath formed crusted, white fibers, and the water bath appeared to form fibers similar to the methanol bath. The remaining baths of ethyl acetate, acetone, and hexanes all resulted in rapid droplet formation from the extruded spin dope; these droplets were immiscible with the bath solvents and did not coagulate. In cases where fibers persisted, the fibers were allowed to remain in their respective coagulation baths overnight to remove the residual EMIC.

For the methanol, acetonitrile, and water coagulation baths, only the fibers from the methanol bath could be handled. Sections of the methanol bath fibers were hand drawn to twice (2×) their as spun length. Both the as spun and 2× methanol rinsed fibers were allowed to air dry to remove the bath solvent. The acetonitrile bath fibers adhered to the bottom of the coagulation bath tank and fractured during attempts to remove them. The water bath fibers broke and collapsed when removed from the bath.

The diameters of the undrawn and 2× draw ratio methanol bath fibers were 250 and 150 μm, respectively. The crystallite alignment of the fibers was further examined by wide angle X-ray scattering (WAXS). The WAXS data for the 2× draw ratio fiber show crystallite alignment along the fiber axis and the peaks for the β-sheet form of silk fibroin. The'crystallite alignment is critical to the strength and toughness of natural *Bombyx mori* silk cocoon fibers.

Example 2

Spinning of Silk Fibroin from *Bombyx mori* with Wet Jet Spinning

For this work, the spin dope was prepared from silkworm cocoon silk dissolved in the ionic liquid 1-butyl-3-methylimidazolium chloride (BMIC). The silk for this work was obtained commercially. To remove the sericin and any sizing agents, the cocoons were boiled heating in 30 times(v/w) of 8M aqueous urea containing 0.04 M Tris-$SO_4$ (pH 7) and 0.5M mercaptoethanol. The stripped silk was rinsed 10 times with deionized water to remove any sericin residue and lyophilized. The dried silk was combined with the dry BMIC to make a 25% (w/w) silk mixture. To dissolve the silk, the spin dope was heated at 110° C. and stirred with a centrifugal mixer under a dry N2 atmosphere. The temperature was reduced to 95° C. after the silk dissolved. A cosolvent of water was added to the admixture in 1% (w/w) increments to a total of 5% (w/w) water to establish a liquid admixture at room temperature. The final admixture was 9.5% (w/w) silk, 85.5% (w/w) BMIC, and 5% (w/w) water.

Silk fibers were formed by forcing the room temperature admixture through a 100 μm nickel spinneret submerged in a 100% methanol coagulation bath. The pressure drop for the spinneret was 7500 psig for a 75 μl/min flow rate. The formed fibers were loosely collected onto a submerged reel and soaked in the methanol bath overnight. The fibers were subsequently transferred to a water bath for a day and then air dried. No post spin drawing was conducted. The mechanical properties of the fibers are listed in Table 2.

TABLE 2

| | Mechanical Properties of Spun Fibers | | |
|---|---|---|---|
| | Diameter (μm) | Modulus (GPa) | Strain to Break (%) |
| Average | 98.9 | 5.00 | 0.481 |
| Standard Deviation | 9.78 | 0.997 | 0.228 |

Example 3

Spinning of Silk Fibroin from *Bombyx mori* Via Extrusion from a Reservoir

For this work, the spin dope was prepared from silkworm cocoon silk dissolved in the ionic liquid 1-butyl-3-methylimidazolium chloride (BMIC). The silk for this work was obtained commercially. To remove the sericin and any sizing agents, the cocoons were boiled heating in 30 times (v/w) of 8M aqueous urea containing 0.04 M Tris-$SO_4$ (pH 7) and 0.5M mercaptoethanol. The stripped silk was rinsed 10 times with deionized water to remove any sericin residue and lyophilized. The dried silk was combined with the dry BMIC to make a 20% (w/w) silk mixture. To dissolve the silk, the spin dope was heated at 110° C. and stirred with a centrifugal mixer under a dry $N_2$ atmosphere. Although the solution solidified when cooled to room temperature, they could be easily reheated without separation.

Silk fibers were formed by placing a reservoir of the spin dope under a dry $N_2$ atmosphere and heating it to 60° C. The fiber drawing was conducted by touching a glass rod to the reservoir surface and pulling a fiber. The pulled fibers were immediately immersed into a coagulation bath of methanol to rinse the ionic liquid from the fibers. The average fiber diameter obtained from this method is 10 μm.

What is claimed is:

1. A process for forming silk or silk-like fibers comprising the steps of:

a) admixing a solute of silk or silk-like proteins with a non-aqueous ionic liquid solvent to form an admixture; and b) forming the fibers by spinning, wherein said fiber spinning is performed by extruding or drawing the admixture through a spinneret.

2. The process of claim 1 where the ionic liquid solvent is a pure species.

3. The process of claim 1 where the ionic liquid solvent is a mixture of more than one ionic liquid.

4. The process of claim 1 wherein the admixture further comprises a cosolvent to adjust the admixture viscosity and stability.

5. The process of claim 4 where the cosolvent is selected from the group consisting of water, methanol, ethanol, 1-propanol, 2-propanol, 1-butanol, 2-butanol, 2-methyl-1-propanol, 2-methyl-2-propanol, acetonitrile and mixtures thereof.

6. The process of claim 1 where the extruded fiber first enters a noncoagulating medium and then enters a coagulating medium.

7. The process of claim 6 where the noncoagulating medium is air, dry air, nitrogen, dry nitrogen or other inert medium.

8. The process of claim 7 where the coagulating medium is any fluid in which the ionic liquid solvent is soluble, and wherein the silk or silk-like protein is not soluble.

9. The process of claim 8 wherein the coagulating medium is selected from the group consisting of water, methanol, ethanol, 1-propanol, 2-propanol, 1-butanol, 2-butanol, 2-methyl-1-propanol, 2-methyl-2-propanol, acetonitrile and mixtures thereof.

10. The process of claim 9 where the fibers are dried to remove the coagulation medium.

11. The process of claim 1 where the spinneret is directly immersed in a coagulating medium.

12. The process of claim 11 where the coagulating medium is any fluid in which the ionic liquid solvent is soluble, and wherein the silk or silk-like protein is not soluble.

13. The process of claim 12 wherein the coagulating medium is selected from the group consisting of water, methanol, ethanol, 1-propanol, 2-propanol, 1-butanol, 2-butanol, 2-methyl-1-propanol, 2-methyl-2-propanol, acetonitrile and mixtures thereof.

14. The process of claim 13 where the fibers are dried to remove the coagulating medium.

15. A process for forming silk or silk-like fibers comprising the steps of a) admixing a solute of silk or silk-like proteins with a non-aqueous ionic liquid solvent to form an admixture; and b) extruding or drawing the fibers from a reservoir immersed in a noncoagulating medium without the aid of a spinneret.

16. The process of claim 15 where the fiber is transferred to a coagulating medium.

17. The process of claim 16 where the noncoagulating medium is air, dry air, nitrogen, dry nitrogen or other inert medium; and where the coagulating medium is any fluid in which the ionic liquid solvent is soluble, and wherein the silk or silk-like protein is not soluble.

18. The process of claim 17 wherein the coagulating medium is selected from the group consisting of water, methanol, ethanol, 1-propanol, 2-propanol, 1-butanol, 2-butanol, 2-methyl-1-propanol, 2-methyl-2-propanol, acetonitrile and mixtures thereof.

19. The process of claim 18 where the fibers are dried to remove the coagulating medium.

* * * * *